US006154150A

United States Patent [19]

Laubach

[11] Patent Number: 6,154,150

[45] Date of Patent: Nov. 28, 2000

[54] VEHICLE POSITIONING APPARATUS

[76] Inventor: Daniel J. Laubach, R.R. 4, N. Highway 77, P.O. Box 1408, Fremont, Nebr. 68026

[21] Appl. No.: 09/444,271

[22] Filed: Nov. 19, 1999

Related U.S. Application Data

[63] Continuation-in-part of application No. 09/211,836, Dec. 15, 1998, abandoned.

[60] Provisional application No. 60/069,808, Dec. 17, 1997.

[51] Int. Cl.[7] ..... B60Q 1/48

[52] U.S. Cl. ..... 340/932.2; 340/988; 340/686.1; 340/933; 340/435; 340/436; 340/309.15; 340/322; 340/332

[58] Field of Search ..... 340/988, 942, 340/932.2, 686.1, 933, 435, 436, 464, 545.1, 693.11, 309.15, 322, 332; 362/802

[56] References Cited

U.S. PATENT DOCUMENTS

| | | | |
|---|---|---|---|
| 2,221,449 | 11/1940 | Hoeninghausen | 88/86 |
| 2,569,576 | 10/1951 | Ramme | 340/932.2 |
| 2,645,159 | 7/1953 | Darroch | 88/86 |
| 2,750,583 | 6/1956 | McCullough | 340/932.2 |
| 3,493,925 | 2/1970 | Brancale | 340/932.2 |
| 3,662,332 | 5/1972 | Zechnowitz et al. | 340/51 |
| 4,015,235 | 3/1977 | Demaine et al. | 340/26 |
| 4,311,983 | 1/1982 | Piper | 340/51 |
| 4,665,378 | 5/1987 | Heckethorn | 340/932.2 |
| 4,808,997 | 2/1989 | Barkley et al. | 340/942 |
| 5,285,205 | 2/1994 | White | 340/932.2 |
| 6,002,346 | 12/1999 | Bowden et al. | 340/932.2 |

FOREIGN PATENT DOCUMENTS

| | | |
|---|---|---|
| 3340687 | 5/1985 | Germany . |
| 0857151 | 8/1981 | U.S.S.R. . |

*Primary Examiner*—Daryl Pope
*Attorney, Agent, or Firm*—Koley Jessen P.C.; Mark D. Frederiksen

[57] ABSTRACT

A vehicle positioning apparatus includes a projection unit mounted above a parking position in a garage or similar enclosure, and having a projector which will project a beam of visible light downwardly onto the parking position. A detection unit is positioned separately from the projection unit, and will detect a specific triggering event in order to activate the projector to emit the lightbeam. The detection unit may include a switch which is actuated upon movement of a garage door to an open position, a motion detector which actuates the projector upon detection of the movement of a vehicle towards the parking position, or an infrared beam positioned to be broken upon movement of a vehicle towards the parking position.

10 Claims, 5 Drawing Sheets

VEHICLE POSITIONING APPARATUS

CROSS-REFERENCE TO RELATED APPLICATION

This is a continuation-in-part application of application Ser. No. 09/211,836 filed Dec. 15, 1998, now abandoned, entitled "VEHICLE POSITIONING APPARATUS" which referred to and claimed the benefit of the filing date of provisional patent application Ser. No. 60/069,808, filed Dec. 17, 1997, entitled APPARATUS FOR INDICATING POSITIONING OF A VEHICLE IN A GARAGE.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to apparatus for positioning vehicles, and more particularly to an improved apparatus which will indicate the location of the vehicle when it is parked in a predetermined position within a garage.

(2) Background of the Invention

Since the invention of the garage, it has been a problem to position a vehicle within the enclosure to provide adequate clearance in front, behind, and on the sides of the vehicle by positioning the vehicle properly within the structure. If the vehicle is located too far rearwardly, the garage door will not close. If the vehicle is located too close to a side of the enclosure, people will not be able to enter or exit the vehicle.

There have been many attempts to provide apparatus which will alert the driver to the appropriate location within the garage for the vehicle. One of the simplest and least expensive apparatus is the use of a ball suspended on a string from the ceiling of the garage. The driver enters the garage until a particular location on the windshield of the vehicle contacts the ball. The main problem with such a device is in the difficulty in positioning the device for a particular vehicle, as well as the difficulty in repositioning the device if a consumer replaces the vehicle. In addition, the suspension of objects from the ceiling can be unsitely in appearance, and can become entangled with structure on the vehicle.

Other attempts to provide apparatus for positioning a vehicle within a garage include U.S. Pat. No. 4,311,983 to Piper. This patent discloses an alarm device which will signal the desired parking position of a vehicle in a garage. The device utilizes a roof mounted antenna which contacts a depending arm when the vehicle reaches the desired position within a garage. Pivotal movement of the arm triggers an audio alarm to cause the driver to stop further movement of the vehicle. However, the Piper device suffers several problems. First, structure is required to project upwardly from the vehicle and downwardly from the garage ceiling. Such projecting structures may become entangled with projections on the vehicle, especially if a different vehicle is parked within the garage. In addition, the mechanical functioning of the apparatus includes many parts which may require repair or replacement, thereby increasing the cost of the apparatus.

Another apparatus known in the art is disclosed in U.S. Pat. No. 4,665,378 to Heckethorn. The Heckethorn device eliminates much of the suspended structure disclosed in Piper, but becomes relatively expensive because of the required interconnection with an automatic garage door opener.

BRIEF SUMMARY OF THE INVENTION

It is therefore a general object of the present invention to provide an improved vehicle positioning apparatus, for visually indicating the position of a vehicle within a garage to the driver of the vehicle.

Another object is to provide a vehicle positioning apparatus which may be easily positioned and mounted within a garage for a variety of vehicle types and sizes.

A further object of the present invention is to provide a vehicle positioning apparatus which does not require an electronic or automatic garage door opener.

Still another object is to provide a vehicle positioning apparatus which is economical to manufacture, refined in appearance and simple to install and use.

These and other objects of the present invention will be apparent to those skilled in the art.

The vehicle positioning apparatus of the present invention includes a projection unit mounted above a parking position in a garage or similar enclosure, and having a projector which will project a beam of visible light downwardly onto the parking position. A detection unit is positioned separately from the projection unit, and will detect a specific triggering event in order to activate the projector to emit the lightbeam. The detection unit may include a switch which is actuated upon movement of a garage door to an open position, a motion detector which actuates the projector upon detection of the movement of a vehicle towards the parking position, or an infrared beam positioned to be broken upon movement of a vehicle towards the parking position.

BRIEF DESCRIPTION OF THE SEVERAL VIEWS OF THE DRAWINGS

The preferred embodiment of the invention is illustrated in the accompanying drawings, in which similar or corresponding parts are identified with the same reference numeral throughout the several views, and in which.

DESCRIPTION OF THE PREFERRED EMBODIMENT

Figure 1:
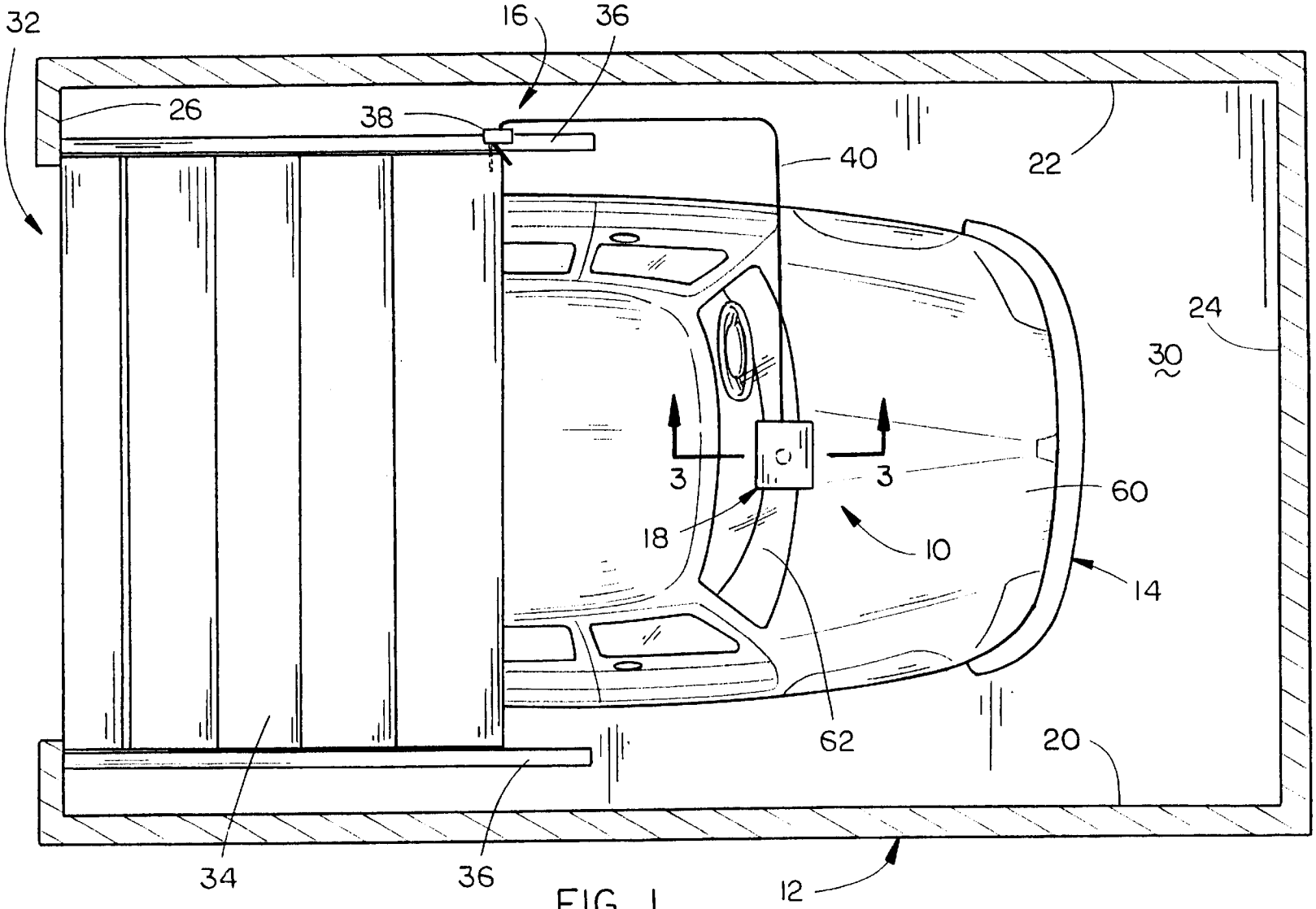
FIG. 1 is a plan view of a garage with the vehicle positioning apparatus of the present invention installed therein.
Figure 2:
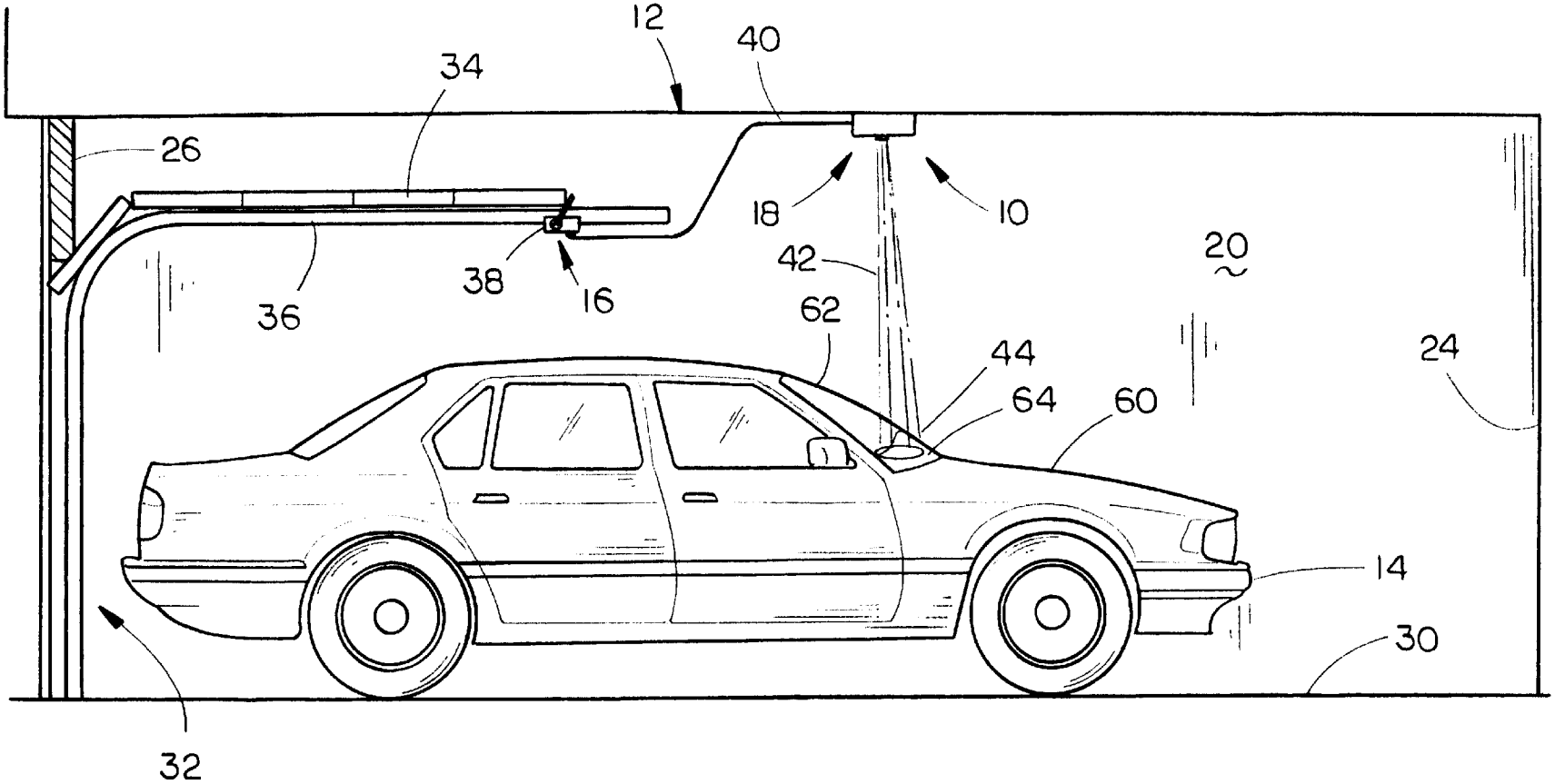
FIG. 2 is a side elevational view of the garage and invention of FIG. 1.

Referring now to the drawings, in which similar or corresponding parts are identified with the same reference numeral, and more particularly to FIGS. 1 and 2, the vehicle positioning apparatus of the present invention is designated generally at 10 and is shown installed in a garage 12 for appropriately positioning a vehicle 14 within the garage 12. Vehicle positioning apparatus 10 generally includes a detection unit 16 which communicates with a projection unit 18 to signal the projection unit to project a light beam downwardly onto vehicle 14 at the desired time.

Garage 12 is a conventional enclosure having side walls 20 and 22, a forward wall 24, a rearward wall 26, a ceiling 28 and a floor 30. Rearward wall 26 has an opening 32 formed therein to permit entry by vehicle 14 into garage 12. An operable garage door 34 is mounted on a track 36 and is operable between open and closed positions, to selectively cover opening 32. While garage door 34 is shown as a sectional overhead door, it should be understood that many other types of doors could be utilized and still fall within the scope of the invention. In fact, it is not required that a garage door 34 be utilized at all with the invention.

In the preferred form of the invention, detection unit 16 is utilized to detect an event where the garage door 34 moves from the closed position to the open position. This may be accomplished in a wide variety of ways, such as the use of a mechanical switch 38 connected to track 36. Switch 38 communicates with projection unit 18 to indicate the detection of door 34 being opened, so as to activate projection unit 18.

In the preferred form of the invention, switch 38 is electrically connected to projection unit 18 via a wire 40 extending therebetween. Obviously, other forms of communication, including infrared communication, radio frequency communication, and other equivalent apparatus, could be used if so desired. Similarly, detection unit 16 could be a variety of similarly functioning devices which are functional to activate projection unit 18 upon the detection of a predetermined event. This predetermined event could be the raising of garage door 34, or the entry of vehicle 14 into the garage. Thus, detection unit 16 could be operable to detect the presence of vehicle 14, rather than detecting the movement or presence of garage door 34.

Projection unit 18 is mounted on ceiling 28 in a position so as to project a light beam 42 downwardly on to a predetermined location on vehicle 14. This predetermined location on the vehicle will be referred to as the target 44 throughout this application. Target 44 is selected by the consumer, since it may be located on vehicle 14 at any convenient location.

Figure 3:
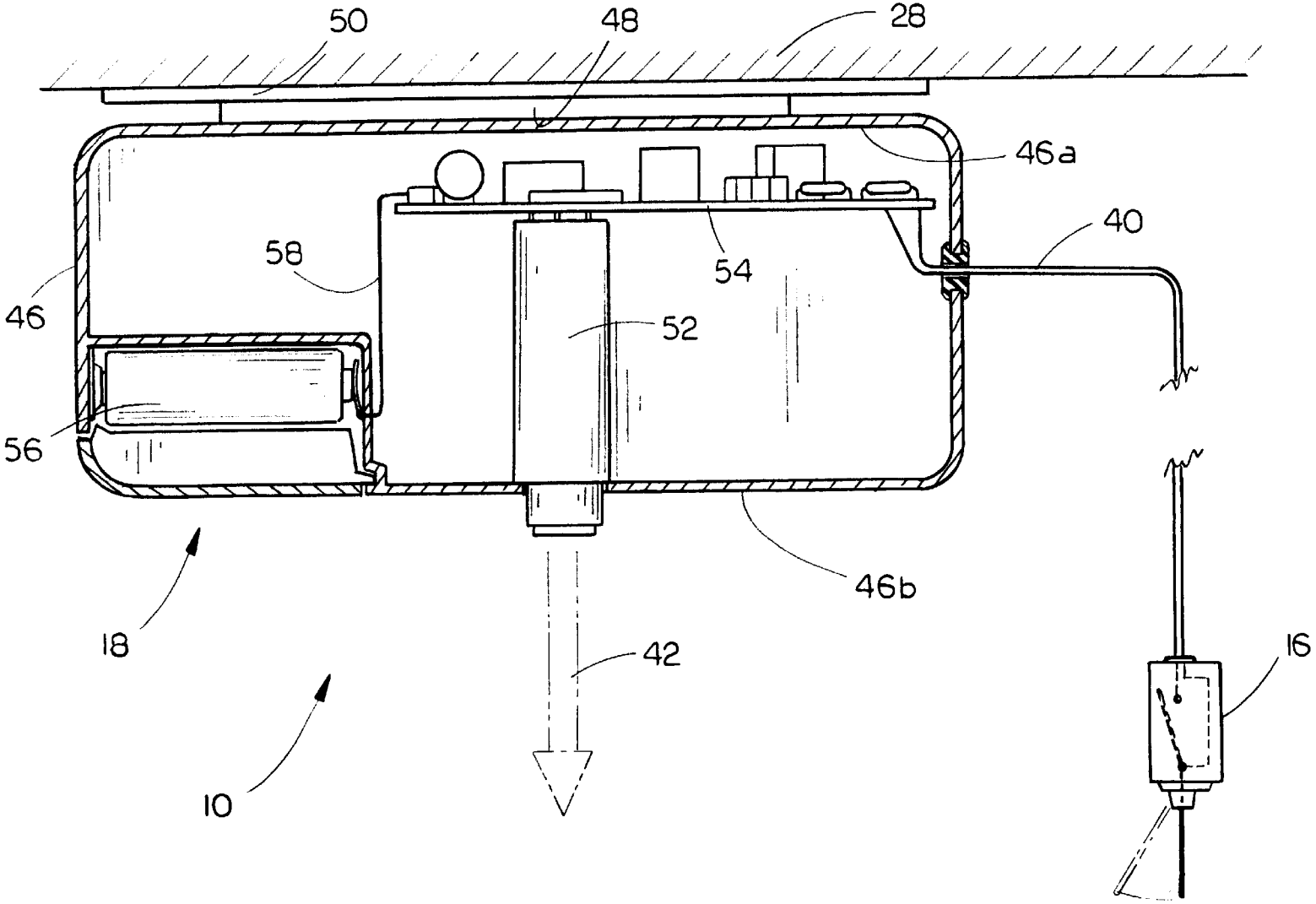
FIG. 3 is a sectional view taken at lines 3—3 in FIG. 1.

Referring now to FIG. 3, projection unit 18 includes a housing 46 having top and bottom walls 46*a* and 46*b* respectively. A strip of hook and loop fastener material 48 is mounted on the upper surface of top wall 46*a* and is selectively movably connected to a hook and loop material sheet 50 attached to ceiling 28. The use of hook and loop fasteners 48 and 50 permits adjustment of housing 46 on ceiling 28 to adjust the location of beam 42 for a particular vehicle. Other types of securement apparatus may be utilized to connect housing 46 to ceiling 28, although the hook and loop fasteners 48 and 50 are the preferred apparatus.

A laser LED 52 is the preferred light source for producing lightbeam 42, and is mounted in the bottom wall 46*b* of housing 46 to project the lightbeam 42 downwardly therefrom. Laser LED 52 is electrically connected to a printed circuit board with the electronic circuitry necessary to operate projection unit 18 thereon. PC board 54 includes a timer for selectively activating laser 52 for a predetermined period of time upon activation by the detection unit 16. Projection unit 18 is preferably powered by a replaceable battery 56 electrically connected to PC board 54 via wires 58. Wire 40 from detection unit 16 is also electrically connected to PC board 54.

Referring once again to FIGS. 1 and 2, vehicle positioning apparatus 10 maybe installed in any location where it is desired to specifically position a vehicle. Thus, positioning apparatus 10 may be installed within an open air carport, a residential garage, or multi-vehicle parking facilities.

The projection unit 18 is then mounted vertically above the location where the vehicle is intended to be located, such that the lightbeam 42 will project on to the hood 60 of the vehicle, or through the windshield 62 on to the dash 64 of the vehicle 14. The detection unit 16 is positioned at a location to detect either the opening of the garage door 34 or the entry of the vehicle 14 into the garage 12.

As discussed above, detection unit 16 will detect a "triggering event", and transmit a signal to projection unit 18 upon the occurrence of that triggering event. Upon receipt of the signal, projection unit 18 will activate, so as to project lightbeam 42 downwardly for a predetermined period of time. Lightbeam 42 will project on to the hood of the vehicle as the vehicle is moved into garage 12, until eventually reaching the target 44. As the lightbeam 42 moves across the hood 60 of vehicle 14, the driver can make adjustments to locate the vehicle 14 both transversely and longitudinally within garage 12, so that lightbeam 42 will align on target 44.

Figure 4:
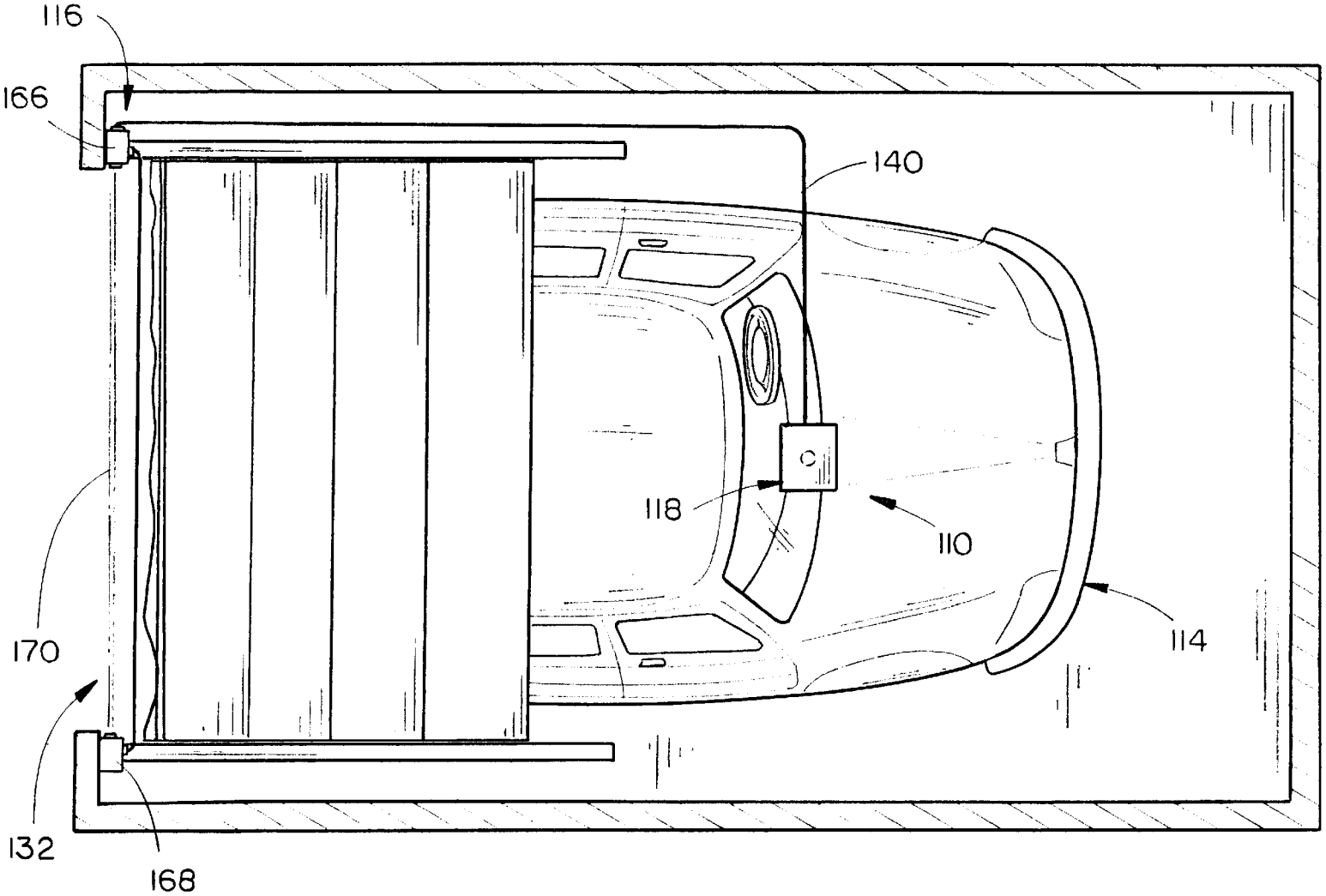
FIG. 4 is a plan view of the garage with a second embodiment of the detection unit installed therein.

Referring now to FIG. 4, a second embodiment of the invention is designated at 110, and includes the same projection unit 118, installed within garage 112 over the parking position of the vehicle 114, as the first embodiment of the invention shown in FIG. 1. Detection unit 116 defers from detection unit 16 in its use of an infrared transmitter and receiver 166 and 168 positioned across opening 132 in garage 112. Transmitter 166 projects a beam 170 towards receiver 168. As vehicle 114 enters garage 112, it will break the beam 170 thereby "detecting" a triggering event which will actuate projection unit 118 in the same fashion as the first embodiment of the invention. Detection unit 116 is electrically connected to projection unit 118 via wire 140.

Figure 5:
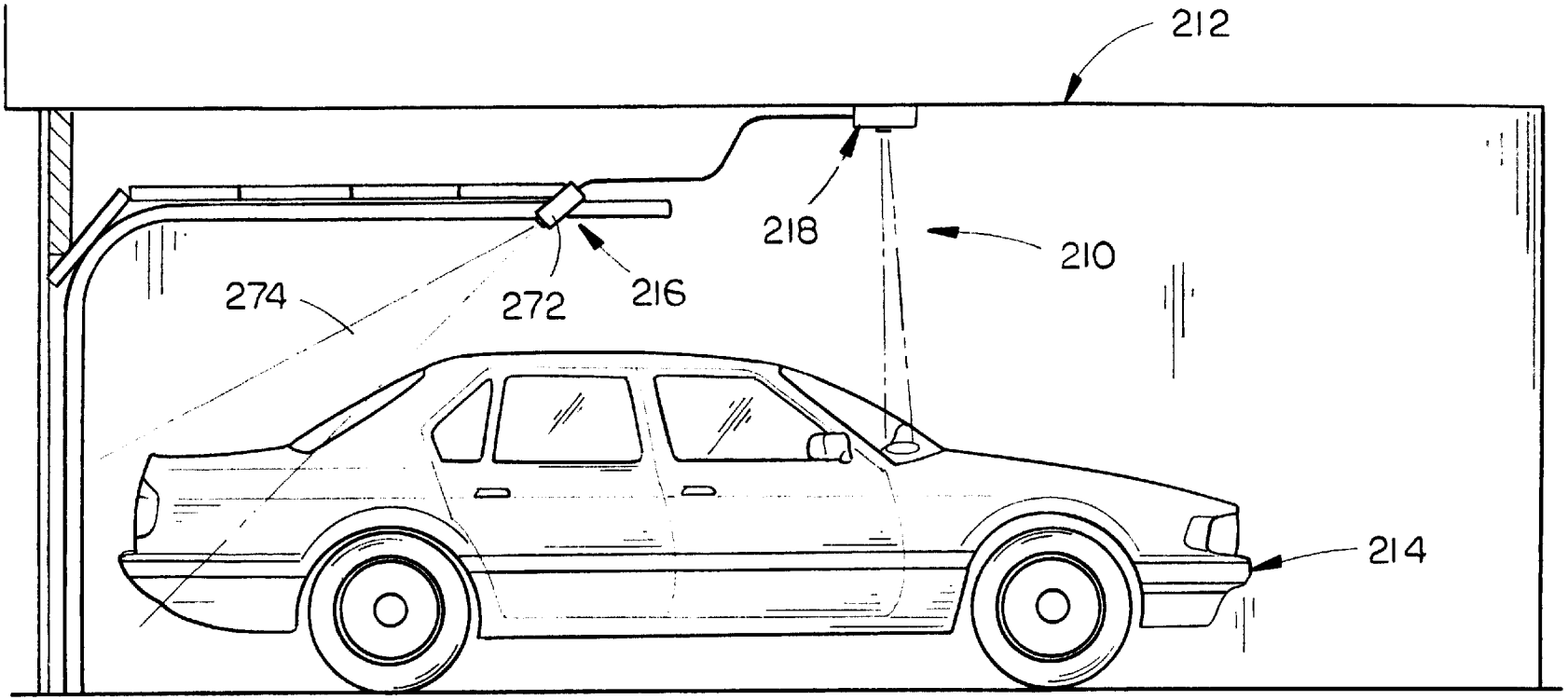
FIG. 5 is a side elevational view of a garage with a third embodiment of the detection unit installed therein.

Referring now to FIG. 5, a third embodiment of the invention is designated generally at 210, and includes the same projection unit 218 mounted within garage 212 over the parking position of vehicle 214, as in the first embodiment of the invention, shown in FIG. 2. Detection unit 216 differs from that of the first embodiment of the invention in the use of a motion detector 272 with a beam 274 directed adjacent to the parking position of vehicle 214, such that vehicle 214 must pass through beam 274 upon entering the garage to park in the parking position.

It can be seen that none of these embodiments of the invention require an automatic garage door opener. Rather, the triggering event is completely separate and independent of any operation or function of a garage door opener. It is either the movement of the garage door, the absence of the garage door (when in an open position), or the movement of a vehicle into a garage, which is the triggering event. For this reason, the inventor's device may be used on all garages, regardless of the presence or absence of a garage door opener.

Whereas the invention has been shown and described in connection with the preferred embodiment thereof, many modifications, substitutions and additions may be made which are within the intended broad scope of the appended claims.

I claim:

1. In combination:

a vehicle parking structure having a floor, and at least one parking position on the floor upon which a vehicle may be parked with a predetermined clearance around the vehicle;

said parking structure including an opening with a door operable between open and closed positions, the opening having dimensions for receiving a vehicle therethrough; and a vehicle positioning apparatus mounted to the structure and operable independently of any garage door opener in the structure including:

an operable projection unit mounted to the structure and having a projector for selectively projecting a beam of visible light downwardly onto the parking position from a location spaced above the floor; and a detection unit for selectively activating the projector upon the detection of movement of the door from the closed to the open position, located spaced from the projection unit and in communication therewith.

2. The combination of claim 1, wherein said projection unit includes a timer electrically connected to the projector, operable to deactivate the projector after a predetermined period of time measured from the activation of the projector.

3. The combination of claim 1, wherein the detection unit includes a switch located proximal the door and operable to activate the projector upon movement of the door to the opened position.

4. The combination of claim 3, wherein said switch is electrically connected to the projector by a wire extending therebetween.

5. The combination of claim 4, wherein said projector includes a laser LED for projecting the lightbeam.

6. The combination of claim 5, wherein said projector includes means for selectively adjustably positioning the projector over the parking position.

7. The combination of claim 6, wherein the parking structure includes a ceiling, and wherein the projection unit is adjustably and removably connected to the ceiling.

8. The combination of claim 1, wherein said projector includes a laser LED for projecting the lightbeam.

9. The combination of claim 1, wherein said projector includes means for selectively adjustably positioning the projector over the parking position.

10. The combination of claim 1, wherein the parking structure includes a ceiling, and wherein the projector unit is adjustably and removably connected to the ceiling.

* * * * *